US010213021B2

(12) United States Patent
Walters

(10) Patent No.: US 10,213,021 B2
(45) Date of Patent: Feb. 26, 2019

(54) MOBILE CHAIR

(71) Applicant: Belinda Walters, Haw River, NC (US)

(72) Inventor: Belinda Walters, Haw River, NC (US)

( * ) Notice: Subject to any disclaimer, the term of this patent is extended or adjusted under 35 U.S.C. 154(b) by 0 days.

(21) Appl. No.: 15/442,330

(22) Filed: Feb. 24, 2017

(65) Prior Publication Data

US 2018/0242745 A1 Aug. 30, 2018

(51) Int. Cl.

| | |
|---|---|
| ***A47C 7/50*** | (2006.01) |
| ***A47C 1/06*** | (2006.01) |
| ***A47C 3/20*** | (2006.01) |
| ***A47C 1/024*** | (2006.01) |
| ***A47C 7/00*** | (2006.01) |
| ***A47C 7/54*** | (2006.01) |

(52) U.S. Cl.

CPC ..... *A47C 1/06* (2013.01); *A47C 1/024* (2013.01); *A47C 3/20* (2013.01); *A47C 7/006* (2013.01); *A47C 7/506* (2013.01); *A47C 7/54* (2013.01)

(58) Field of Classification Search

CPC .. A47C 1/04; A47C 1/024; A47C 3/20; A47C 7/006; A47C 7/506; A47C 7/54; A61G 5/1059; A61G 5/1067

USPC ..... 297/344.12

See application file for complete search history.

(56) References Cited

U.S. PATENT DOCUMENTS 1,977,159 A * 10/1934 Tursi ..... A47C 1/10 297/112
2,738,593 A 3/1956 Fox
D177,765 S 5/1958 Romito
2,954,955 A * 10/1960 Feller ..... A47C 7/68 248/231.41
3,601,443 A * 8/1971 Jones ..... A47C 1/11 108/103
3,994,528 A * 11/1976 Humphrey ..... A47C 1/04 15/301
D256,967 S 9/1980 Hirota
4,372,605 A * 2/1983 Cervantes ..... A47C 1/04 297/188.11
4,685,736 A * 8/1987 Tanaka ..... B60N 2/2213 297/366
4,790,600 A * 12/1988 Behringer ..... A47C 1/022 297/296
5,489,140 A 2/1996 Van Horn-Plato
5,547,253 A * 8/1996 Schwartz ..... A47C 3/30 297/338
5,690,185 A 11/1997 Sengel
(Continued)

FOREIGN PATENT DOCUMENTS

WO WO2014094083 6/2014

*Primary Examiner* — Shin H Kim

(57) ABSTRACT

A mobile chair for use in salons and other locations includes a base. A plurality of rollers is coupled to and extends from a lower face of the base. The base is configured for locomotion across a surface. A brake is coupled to the base. A lift is coupled to and extends from an upper face of the base. A seat is coupled to the lift distal from the base. A backrest is pivotally coupled to and extends from a rear of the seat. The brake is configured to selectively couple to at least one roller such that locomotion of the base is prevented. The lift is configured for the operator to selectively vertically position the seat relative to the base. The backrest is configured for the operator to selectively angularly position the backrest relative to the seat.

19 Claims, 5 Drawing Sheets

(56) References Cited

U.S. PATENT DOCUMENTS 6,076,891 A * 6/2000 Bernhardt ..... A47C 1/03 297/411.31
6,149,239 A * 11/2000 Markussen ..... A47C 7/52 248/123.11
6,182,583 B1 * 2/2001 Larson ..... A47B 9/10 108/147
6,196,631 B1 3/2001 Larson
6,296,310 B1 * 10/2001 Laudenslayer ..... A47C 1/06 297/344.19
6,517,162 B2 2/2003 Cheng
6,523,898 B1 * 2/2003 Ball ..... A47C 1/023 297/284.4
6,533,360 B1 * 3/2003 Parkel ..... A47C 7/506 297/423.28
6,616,238 B1 * 9/2003 Guery-Strahm ..... A47C 9/002 297/440.1
6,698,833 B2 * 3/2004 Ball ..... A47C 1/023 297/284.4
6,761,339 B2 * 7/2004 Minami ..... A47C 1/06 248/161
6,793,232 B1 * 9/2004 Wing ..... A61G 5/006 280/304.1
6,896,328 B2 * 5/2005 Goodworth ..... A47C 3/026 297/297
6,913,315 B2 * 7/2005 Ball ..... A47C 1/023 297/284.4
6,986,310 B2 * 1/2006 Calfas ..... A61G 5/1059 108/147
7,004,546 B1 * 2/2006 Thisius ..... A47C 7/543 297/411.33
7,077,477 B1 * 7/2006 Syrowik ..... B60N 2/753 297/411.32
7,452,032 B1 * 11/2008 Roleder ..... A47C 7/54 297/182
7,530,639 B2 * 5/2009 Groelsma ..... A47C 1/03255 297/344.18
7,600,815 B2 * 10/2009 Corcoran ..... A61G 5/14 297/330
7,611,207 B2 * 11/2009 Barfuss ..... A47C 1/06 297/423.2
7,857,390 B2 * 12/2010 Schmitz ..... A47C 1/03255 297/300.1
7,922,134 B2 * 4/2011 Gasser ..... A47C 7/004 16/31 A
7,992,937 B2 * 8/2011 Plikat ..... A47C 1/03255 297/300.2
8,177,297 B2 * 5/2012 Powell ..... A47D 1/008 297/148
8,534,762 B2 * 9/2013 Linhoff ..... A47C 7/506 297/423.26
8,646,842 B2 * 2/2014 Barfuss ..... A47C 1/06 297/284.9
9,713,559 B2 * 7/2017 Hough ..... A61G 5/14
9,839,292 B2 * 12/2017 Miller ..... A47C 1/03255
2007/0136941 A1 * 6/2007 Giardina ..... A45D 19/10 4/515
2008/0016736 A1 7/2008 Leifer
2010/0301640 A1 12/2010 Heiser
2011/0272976 A1 * 11/2011 Wei ..... A47C 1/022 297/195.11
2012/0086257 A1 * 4/2012 Wald ..... A47C 7/506 297/423.19
2012/0124735 A1 5/2012 Weiss
2012/0319447 A1 * 12/2012 Barfuss ..... A47C 1/06 297/408
2015/0196123 A1 * 7/2015 Buehrer ..... A47C 1/0347 297/325
2015/0282621 A1 * 10/2015 Miller ..... A47C 1/03255 297/188.01
2017/0340116 A1 * 11/2017 Paul ..... A61G 5/14
2018/0042799 A1 * 2/2018 Upchurch ..... A61G 5/101

* cited by examiner

MOBILE CHAIR

BACKGROUND OF THE DISCLOSURE

Field of the Disclosure

The disclosure relates to mobile chairs and more particularly pertains to a new mobile chair for use in salons and other locations.

SUMMARY OF THE DISCLOSURE

An embodiment of the disclosure meets the needs presented above by generally comprising a base. A plurality of rollers is coupled to and extends from a lower face of the base. The base is configured for locomotion across a surface. A brake is coupled to the base. A lift is coupled to and extends from an upper face of the base. A seat is coupled to the lift distal from the base. A backrest is pivotally coupled to and extends from a rear of the seat. The brake is configured to selectively couple to at least one roller such that locomotion of the base is prevented. The lift is configured for the operator to selectively vertically position the seat relative to the base. The backrest is configured for the operator to selectively angularly position the backrest relative to the seat.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
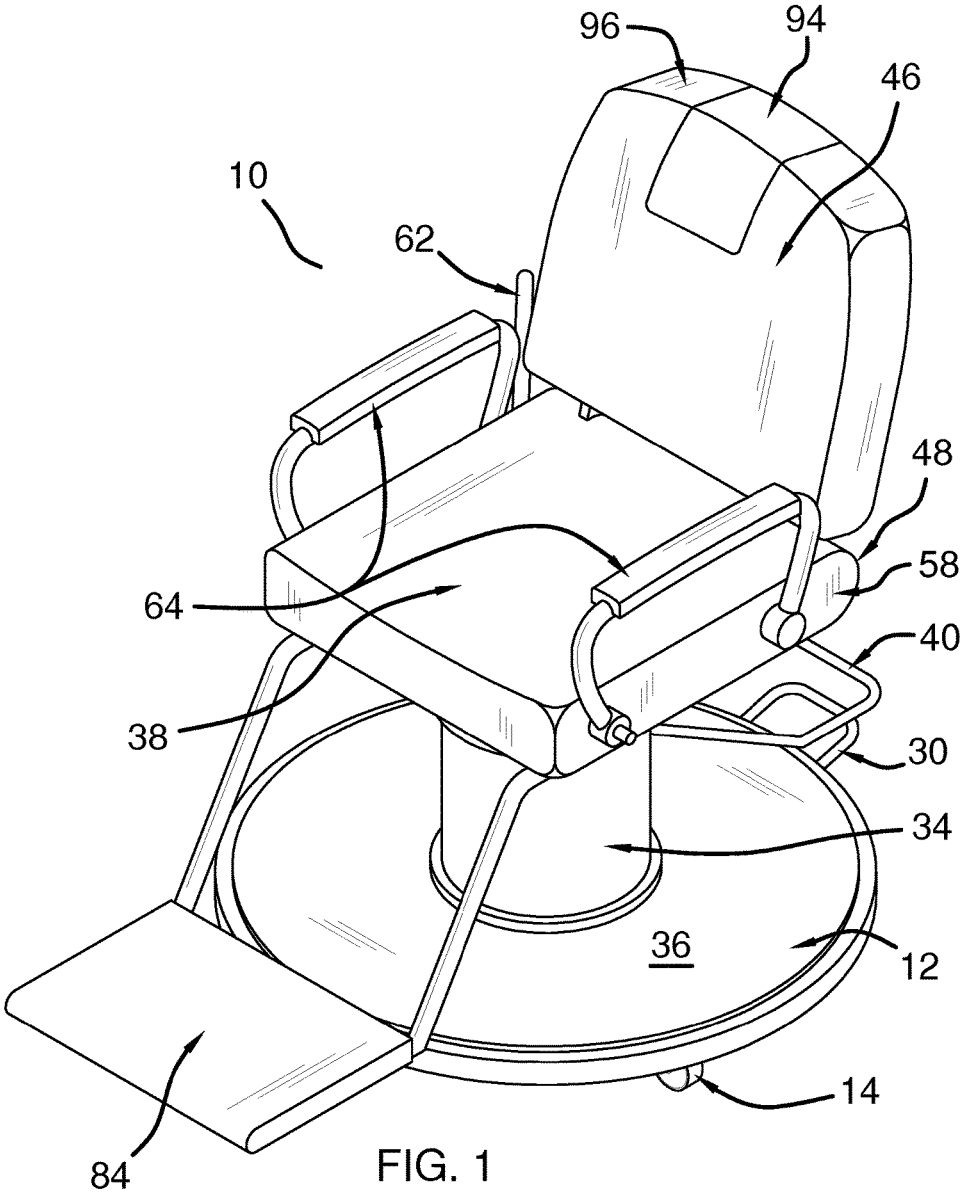
FIG. 1 is an isometric perspective view of a mobile chair according to an embodiment of the disclosure.
Figure 2:
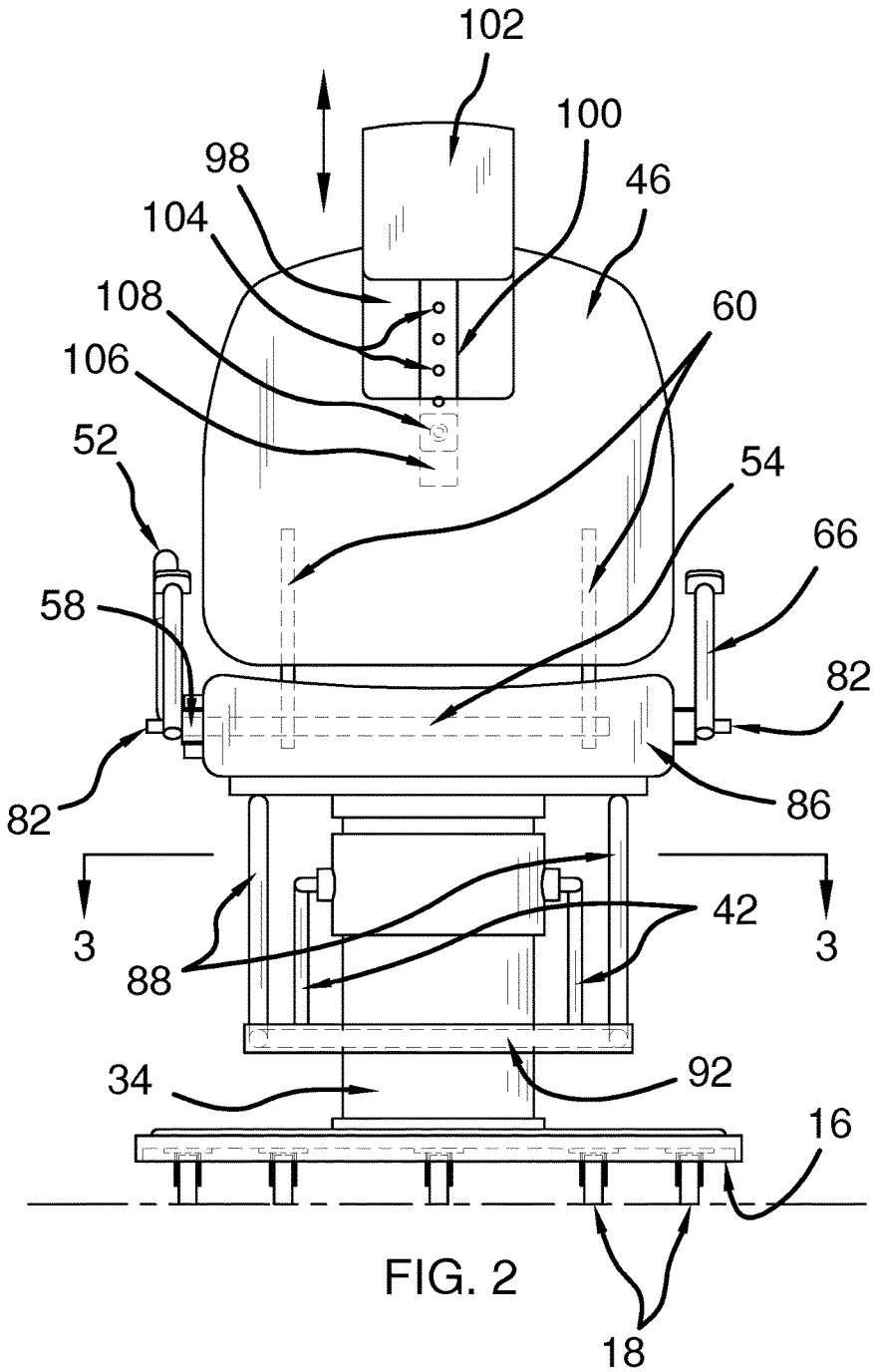
FIG. 2 is a front view of an embodiment of the disclosure.
Figure 3:
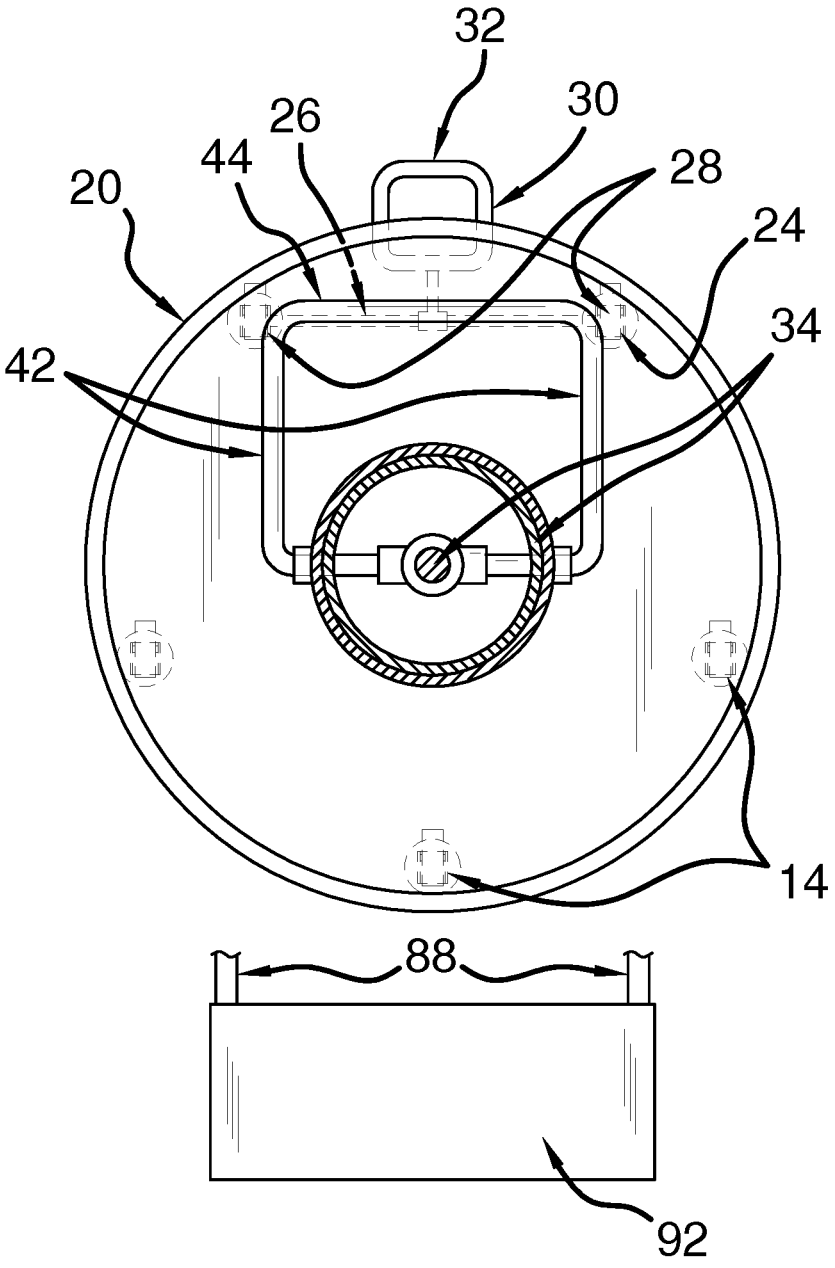
FIG. 3 is a cross-sectional view of an embodiment of the disclosure.
Figure 4:
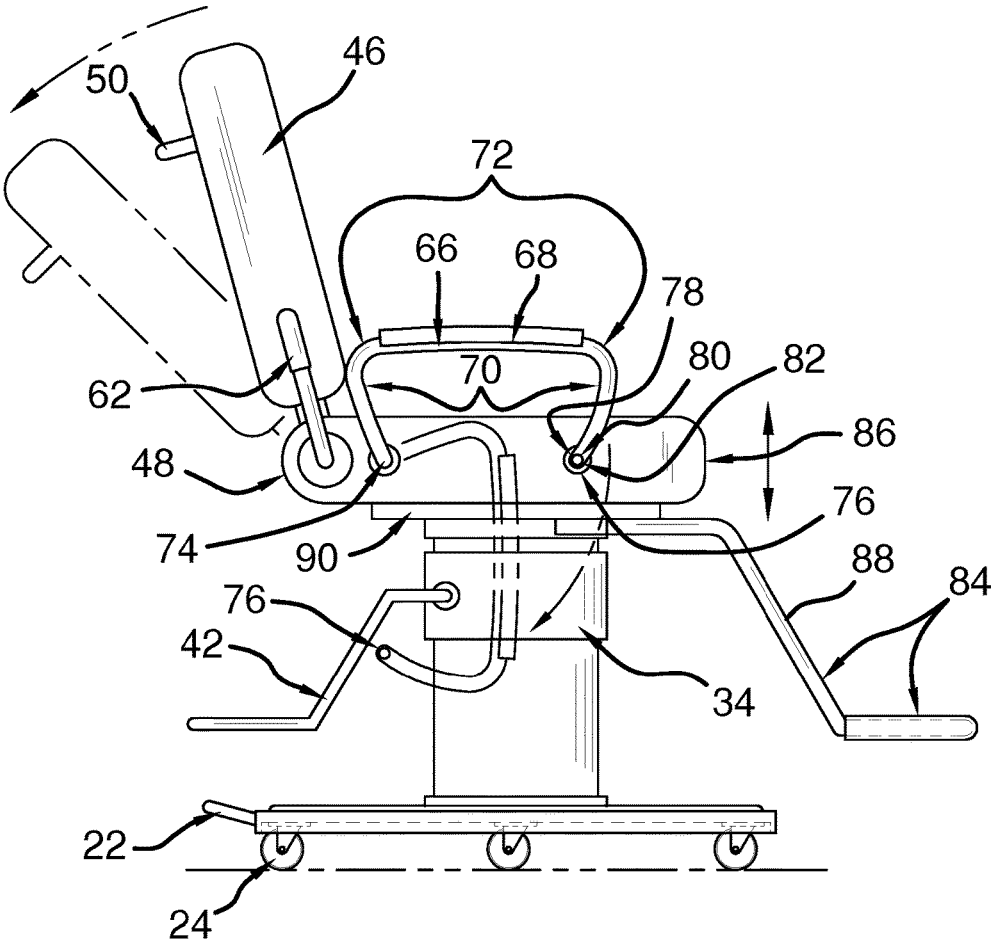
FIG. 4 is a side view of an embodiment of the disclosure.
Figure 5:
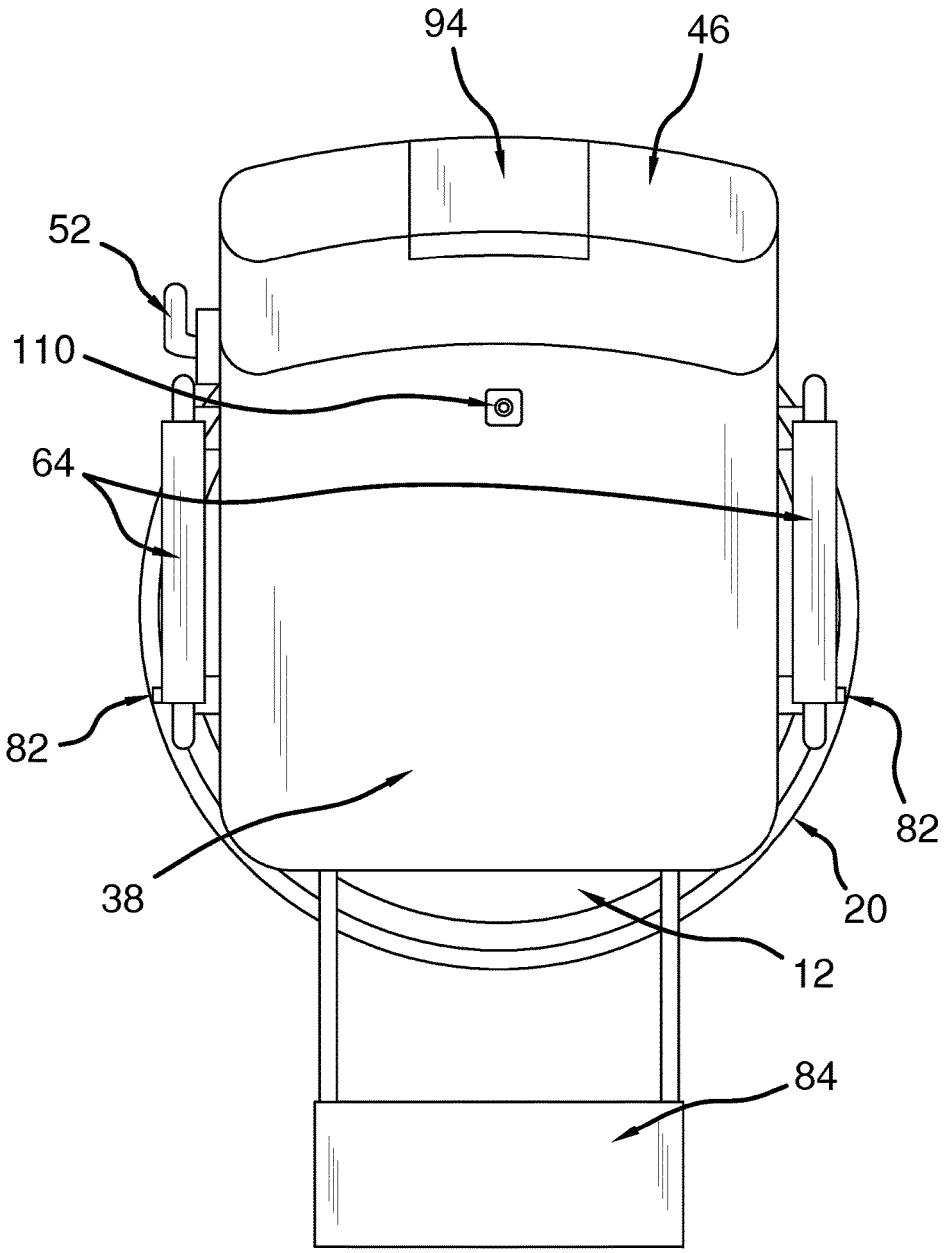
FIG. 5 is a top view of an embodiment of the disclosure.

With reference now to the drawings, and in particular to FIGS. 1 through 5 thereof, a new mobile chair embodying the principles and concepts of an embodiment of the disclosure and generally designated by the reference numeral 10 will be described.

As best illustrated in FIGS. 1 through 5, the mobile chair 10 generally comprises a base 12. In one embodiment, the base 12 is circularly shaped.

A plurality of rollers 14 is coupled to and extends from a lower face 16 of the base 12. The rollers 14 are positioned on the base 12 such that the base 12 is configured for locomotion across a surface. In one embodiment, the rollers 14 comprise castors 18. In another embodiment, the plurality of rollers 14 comprises five rollers 14. In yet another embodiment, the plurality of rollers 14 is substantially evenly distributed around a perimeter 20 of the base 12.

A brake 22 is coupled to the base 12. The brake 22 is selectively couplable to at least one roller 24. The brake 22 is positioned on the base 12 such that the brake 22 is configured for an operator to selectively couple the brake 22 to the at least one roller 24. With the brake 22 coupled to the at least one roller 24, locomotion of the base 12 is prevented.

In one embodiment, the brake 22 comprises a first rod 26 that is rotationally coupled to the lower face 16 of the base 12. The first rod 26 extends between an adjacent pair of rollers 28. The first rod 26 is selectively couplable to each of the adjacent pair of rollers 28. A pedal 30 is coupled to and extends from the first rod 26 such that an outer edge 32 of the pedal 30 protrudes from the perimeter 20 of the base 12. In another embodiment, the pedal 30 is positioned equally distant from each of the adjacent pair of rollers 28. The pedal 30 is positioned on the first rod 26 such that the pedal 30 is configured for reversible depression by the operator. The first rod 26 selectively couples to the adjacent pair of rollers 28 such that locomotion of the base 12 is prevented.

A lift 34 is coupled to and extends from an upper face 36 of the base 12. In one embodiment, the lift 34 is centrally positioned on the base 12. In another embodiment, the lift 34 is hydraulic.

A seat 38 is coupled to the lift 34 distal from the base 12. The seat 38 is positioned on the lift 34 such that the lift 34 is configured to allow the operator to selectively vertically position the seat 38 relative to the base 12. In one embodiment, the seat 38 is substantially rectangularly shaped. In another embodiment, the seat 38 is padded.

An adjuster 40 is operationally coupled to and extends angularly from the lift 34. The adjuster 40 is positioned on the lift 34 such that the adjuster 40 is configured to allow the operator to selectively vertically position the seat 38 relative to the base 12.

In one embodiment, the adjuster 40 comprises a pair of bars 42 and a crosspiece 44. Each bar 42 is operationally coupled to and extends angularly from the lift 34. The crosspiece 44 is coupled to and extends between the bars 42 distal from the lift 34. The crosspiece 44 is positioned on the bars 42 such that the crosspiece 44 is configured to allow the operator to selectively vertically motivate the crosspiece 44 to selectively position the seat 38 relative to the base 12.

A backrest 46 is pivotally coupled to and extends from a rear 48 of the seat 38. The backrest 46 is positioned on the seat 38 such that the backrest 46 is configured to allow the operator to selectively angularly position the backrest 46 relative to the seat 38. In one embodiment, the backrest 46 is substantially rectangularly shaped. In another embodiment, the backrest 46 is padded.

A handle 50 is coupled to the backrest 46. The handle 50 is positioned on the backrest 46 such that the handle 50 is configured to be grasped in a hand of the operator to assist in locomotion of the base 12.

A controller 52 is coupled to the seat 38. The controller 52 is operationally coupled to the backrest 46. The controller 52 is positioned on the seat 38 such that the controller 52 is configured to allow the operator to selectively position the backrest 46 relative to the seat 38.

In one embodiment, the controller 52 comprises a second rod 54 that is positioned in the seat 38 proximate to the rear 48. The second rod 54 has a terminus 56 that protrudes through a respective opposing side 58 of the seat 38. Each of a pair of third rods 60 is coupled to and extends perpendicularly from the second rod 54. The third rods 60 are coupled to the backrest 46. A lever 62 is coupled to and extends from the terminus 56 of the second rod 54. The lever 62 is positioned on the second rod 54 such that the lever 62 is configured to allow the operator to selectively rotate the second rod 54 such that the third rods 60 and the backrest 46 are selectively positionable relative to the seat 38.

Each of a pair of armrests 64 is selectively couplable singly to the opposing sides 58 of the seat 38. Each armrest 64 is positioned on the respective opposing side 58 of the seat 38 such that the armrest 64 is configured to selectively decouple from the seat 38. The seat 38 is configured to allow entry of the user over the respective opposing side 58.

In one embodiment, the armrest 64 comprises a fourth rod 66. The fourth rod 66 has a linear section 68 and a pair of curved sections 70. The curved sections 70 extend singly from opposing endpoints 72 of the linear section 68 and define a first endpoint 74 and a second endpoint 76 of the armrest 64. The first endpoint 74 is pivotally coupled to the respective opposing side 58 of the seat 38 proximate to the rear 48. The second endpoint 76 is reversibly couplable to the respective opposing side 58 such that the linear section 68 is positionable above and substantially parallel to the respective opposing side 58. In another embodiment, the pair of armrests 64 are padded.

In yet another embodiment, each of a pair of holes 78 is positioned singly through the pair of armrests 64 proximate to the second endpoints 76. Each of a pair of penetrations 80 is positioned singly through the opposing sides 58 of the seat 38. Each penetration 80 is alignable with an associated hole 78 when the linear section 68 is positioned above and substantially parallel to the respective opposing side 58. A pair of pins 82 is complementary to the holes 78 and the penetrations 80. Each pin 82 is slidably coupled to a respective armrest 64 through the associated hole 78. Each pin 82 is reversibly insertable into an associated penetration 80 to reversibly couple the respective armrest 64 to the associated opposing side 58 of the seat 38.

A footrest 84 is coupled to the seat 38. The footrest 84 extends angularly from a front 86 of the seat 38. The footrest 84 is positioned on the seat 38 such that the footrest 84 is configured to position feet of the user that is positioned on the seat 38.

In one embodiment, the footrest 84 comprises a pair of fifth rods 88 that is coupled to a bottom 90 of the seat 38 and extend angularly from the front 86 of the seat 38. The fifth rods 88 are positioned singly proximate to the opposing sides 58 of the seat 38. A plate 92 is coupled to and extends between the fifth rods 88 distal from the seat 38. The plate 92 is substantially parallel planarly positioned below the seat 38.

A headrest 94 is coupled to and selectively extendable from a top end 96 of the backrest 46. The headrest is positioned to be extended from the backrest 46 such that the headrest 94 is configured to support a head of the user who is positioned on the seat 38 as the backrest 46 is selectively angularly positioned relative to the seat 38.

In one embodiment, the headrest 94 comprises a recess 98 that is positioned in the backrest 46. A sixth rod 100 is coupled to and extends from an insert 102 that is complementary to the recess 98. The sixth rod 100 is flat. A plurality of holes 104 is positioned through the sixth rod 100. A channel 106 is positioned in the backrest 46. The channel 106 is complementary to the sixth rod 100 such that the sixth rod 100 is selectively positionable within the channel 106. A spring pin 108 is coupled to the backrest 46 proximate to the channel 106. The holes 104 are positioned in the sixth rod 100 such that the holes 104 are positioned for selective insertion of the spring pin 108 to fixedly position the insert 102 relative to the backrest 46. A button 110 is coupled to the backrest 46. The button 110 is depressible and operationally coupled to the spring pin 108. The button 110 is positioned to be depressed to decouple the spring pin 108 from the sixth rod 100 such that the insert 102 is selectively positionable relative to the backrest 46.

In use, the rollers 14 are positioned on the base 12 such that the base 12 is configured for locomotion across a surface. The brake 22 is positioned on the base 12 such that the brake 22 is configured for the operator to selectively couple the brake 22 to the at least one roller 24 such that locomotion of the base 12 is prevented. Each armrest 64 is positioned on the respective opposing side 58 of the seat 38 such that the armrest 64 is configured to selectively decouple from the seat 38. The seat 38 is configured to allow entry of the user over the respective opposing side 58. The footrest 84 is positioned on the seat 38 such that the footrest 84 is configured to position the feet of the user that is positioned on the seat 38. The seat 38 is positioned on the lift 34 such that the lift 34 is configured to allow the operator to selectively vertically position the seat 38 relative to the base 12. The backrest 46 is positioned on the seat 38 such that the backrest 46 is configured to allow the operator to selectively angularly position the backrest 46 relative to the seat 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A mobile chair comprising:

a base;

a plurality of rollers coupled to and extending from a lower face of said base;

a brake coupled to said base, said brake being selectively couplable to at least one said roller, said brake comprising a first rod rotationally coupled to said lower face of said base, said first rod extending between an adjacent pair of said rollers, said first rod being selectively couplable to each of said adjacent pair of said rollers, a pedal coupled to and extending from said first rod such that an outer edge of said pedal protrudes from said perimeter of said base, said pedal being positioned equally distant from each of said adjacent pair of said rollers, and wherein said pedal is positioned on said first rod such that said pedal is configured for reversible depression by the operator such that said first rod selectively couples to said adjacent pair of said rollers such that locomotion of said base is prevented;

a lift coupled to and extending from an upper face of said base;

a seat coupled to said lift distal from said base;

a backrest pivotally coupled to and extending from a rear of said seat; and wherein said rollers are positioned on said base such that said base is configured for locomotion across a surface, wherein said brake is positioned on said base such that said brake is configured for an operator to selectively couple said brake to said at least one said roller such that locomotion of said base is prevented, wherein said seat is positioned on said lift such that said lift is configured for the operator to selectively vertically position said seat relative to said base, wherein said backrest is positioned on said seat such that said backrest is configured for the operator to selectively angularly position said backrest relative to said seat.

2. The chair of claim 1, further including said base being circularly shaped.

3. The chair of claim 1, further including said rollers comprising castors.

4. The chair of claim 1, further comprising:

said plurality of rollers comprising five said rollers; and said plurality of rollers being substantially evenly distributed around a perimeter of said base.

5. The chair of claim 1, further including said lift being centrally positioned on said base, said lift being hydraulic.

6. The chair of claim 1, further including said seat and said backrest being substantially rectangularly shaped, said seat and said backrest being padded.

7. The chair of claim 1, further including an adjuster operationally coupled to and extending angularly from said lift, wherein said adjuster is positioned on said lift such that said adjuster is configured for the operator to selectively vertically position said seat relative to said base.

8. The chair of claim 7, further including said adjuster comprising a pair of bars and a crosspiece, each said bar being operationally coupled to and extending angularly from said lift, said crosspiece being coupled to and extending between said bars distal from said lift, wherein said crosspiece is positioned on said bars such that said crosspiece is configured for the operator to selectively vertically motivate said crosspiece to selectively position said seat relative to said base.

9. The chair of claim 1, further including a handle coupled to said backrest, wherein said handle is positioned on said backrest such that said handle is configured for grasping in a hand of the operator to assist in locomotion of said base.

10. The chair of claim 1, further including a controller coupled to said seat, said controller being operationally coupled to said backrest, wherein said controller is positioned on said seat such that said controller is configured for the operator to selectively position said backrest relative to said seat.

11. A mobile chair comprising:

a base;

a plurality of rollers coupled to and extending from a lower face of said base;

a brake coupled to said base, said brake being selectively couplable to at least one said roller;

a lift coupled to and extending from an upper face of said base;

a seat coupled to said lift distal from said base;

a backrest pivotally coupled to and extending from a rear of said seat; and wherein said rollers are positioned on said base such that said base is configured for locomotion across a surface, wherein said brake is positioned on said base such that said brake is configured for an operator to selectively couple said brake to said at least one said roller such that locomotion of said base is prevented, wherein said seat is positioned on said lift such that said lift is configured for the operator to selectively vertically position said seat relative to said base, wherein said backrest is positioned on said seat such that said backrest is configured for the operator to selectively angularly position said backrest relative to said seat; and a controller coupled to said seat, said controller being operationally coupled to said backrest, wherein said controller is positioned on said seat such that said controller is configured for the operator to selectively position said backrest relative to said seat, said controller comprising a second rod positioned in said seat proximate to said rear, said second rod having a terminus protruding through a respective opposing side of said seat;

a pair of third rods coupled to and extending perpendicularly from said second rod, said third rods being coupled to said backrest;

a lever coupled to and extending from said terminus of said second rod; and wherein said lever is positioned on said second rod such that said lever is configured for the operator to selectively rotate said second rod such that said third rods and said backrest are selectively positionable relative to said seat.

12. The chair of claim 1, further including a pair of armrests selectively couplable singly to opposing sides of said seat, wherein each said armrest is positioned on a respective opposing side of said seat such that said armrest is configured for selective decoupling such that said seat is configured for entry of the user over said respective said opposing side.

13. The chair of claim 12, further including each said armrest comprising a fourth rod having a linear section and a pair of curved sections, said curved sections extending singly from opposing endpoints of said linear section defining a first endpoint and a second endpoint of said armrest, said first endpoint being pivotally coupled to said respective said opposing side of said seat proximate to said rear, said second endpoint being reversibly couplable to said respective said opposing side such that said linear section is positionable above and substantially parallel to said respective said opposing side, said pair of armrests being padded.

14. The chair of claim 13, further comprising:

a pair of holes positioned singly through said pair of armrests proximate to said second endpoints;

a pair of penetrations being positioned singly through said opposing sides of said seat such that each said penetration is alignable with an associated said hole when said linear section is positioned above and substantially parallel to said respective said opposing side; and a pair of pins complementary to said holes and said penetrations, each said pin being slidably coupled to a respective said armrest through said associated said hole, each said pin being reversibly insertable into an associated said penetration to reversibly couple said respective said armrest to said associated said opposing side of said seat.

15. The chair of claim 1, further including a footrest coupled to said seat, said footrest extending angularly from a front of said seat, wherein said footrest is positioned on said seat such that said footrest is configured for positioning of feet of the user positioned on said seat.

16. The chair of claim 1, further including said footrest comprising:

a pair of fifth rods coupled to a bottom of said seat and extending angularly from said front of said seat, said fifth rods being positioned singly proximate to opposing sides of said seat; and a plate coupled to and extending between said fifth rods distal from said seat such that said plate is substantially parallel planarly positioned below said seat.

17. The chair of claim 1, further including a headrest coupled to and selectively extendable from a top end of said backrest, wherein said headrest is positioned for extension from said backrest such that said headrest is configured to support a head of the user who is positioned on said seat as said backrest is selectively angularly positioned relative to said seat.

18. The chair of claim 17, further including said headrest comprising:

a recess positioned in said backrest;

an insert complementary to said recess;

a sixth rod coupled to and extending from said insert, said sixth rod being flat;

a plurality of holes positioned through said sixth rod;

a channel positioned in said backrest, said channel being complementary to said sixth rod such that said sixth rod is selectively positionable within said channel;

a spring pin coupled to said backrest proximate to said channel 106, wherein said holes are positioned in said sixth rod such that said holes are positioned for selectively inserting said spring pin to fixedly position said insert relative to said backrest; and a button coupled to said backrest, said button being depressible, said button being operationally coupled to said spring pin, wherein said button is positioned for depressing to decouple said spring pin from said sixth rod such that said insert is selectively positionable relative to said backrest.

19. A mobile chair comprising:

a base, said base being circularly shaped;

a plurality of rollers coupled to and extending from a lower face of said base, wherein said rollers are positioned on said base such that said base is configured for locomotion across a surface, said rollers comprising castors, said plurality of rollers comprising five said rollers, said plurality of rollers being substantially evenly distributed around a perimeter of said base;

a brake coupled to said base, said brake being selectively couplable to at least one said roller, wherein said brake is positioned on said base such that said brake is configured for an operator to selectively couple said brake to said at least one said roller such that locomotion of said base is prevented, said brake comprising:

a first rod rotationally coupled to said lower face of said base, said first rod extending between an adjacent pair of said rollers, said first rod being selectively couplable to each of said adjacent pair of said rollers, a pedal coupled to and extending from said first rod such that an outer edge of said pedal protrudes from said perimeter of said base, said pedal being positioned equally distant from each of said adjacent pair of said rollers, and wherein said pedal is positioned on said first rod such that said pedal is configured for reversible depression by the operator such that said first rod selectively couples to said adjacent pair of said rollers such that locomotion of said base is prevented;

a lift coupled to and extending from an upper face of said base, said lift being centrally positioned on said base, said lift being hydraulic;

a seat coupled to said lift distal from said base, wherein said seat is positioned on said lift such that said lift is configured for the operator to selectively vertically position said seat relative to said base, said seat being substantially rectangularly shaped, said seat being padded;

an adjuster operationally coupled to and extending angularly from said lift, wherein said adjuster is positioned on said lift such that said adjuster is configured for the operator to selectively vertically position said seat relative to said base, said adjuster comprising a pair of bars and a crosspiece, each said bar being operationally coupled to and extending angularly from said lift, said crosspiece being coupled to and extending between said bars distal from said lift, wherein said crosspiece is positioned on said bars such that said crosspiece is configured for the operator to selectively vertically motivate said crosspiece to selectively position said seat relative to said base;

a backrest pivotally coupled to and extending from a rear of said seat, wherein said backrest is positioned on said seat such that said backrest is configured for the operator to selectively angularly position said backrest relative to said seat, said backrest being substantially rectangularly shaped, said backrest being padded;

a handle coupled to said backrest, wherein said handle is positioned on said backrest such that said handle is configured for grasping in a hand of the operator to assist in locomotion of said base;

a controller coupled to said seat, said controller being operationally coupled to said backrest, wherein said controller is positioned on said seat such that said controller is configured for the operator to selectively position said backrest relative to said seat, said controller comprising:

a second rod positioned in said seat proximate to said rear, said second rod having a terminus protruding through a respective opposing side of said seat, a pair of third rods coupled to and extending perpendicularly from said second rod, said third rods being coupled to said backrest, a lever coupled to and extending from said terminus of said second rod, and wherein said lever is positioned on said second rod such that said lever is configured for the operator to selectively rotate said second rod such that said third rods and said backrest are selectively positionable relative to said seat;

a pair of armrests selectively couplable singly to said opposing sides of said seat, wherein each said armrest is positioned on said respective opposing side of said seat such that said armrest is configured for selective decoupling such that said seat is configured for entry of the user over said respective said opposing side, each said armrest comprising a fourth rod having a linear section and a pair of curved sections, said curved sections extending singly from opposing endpoints of said linear section defining a first endpoint and a second endpoint of said armrest, said first endpoint being pivotally coupled to said respective said opposing side of said seat proximate to said rear, said second endpoint being reversibly couplable to said respective said opposing side such that said linear section is positionable above and substantially parallel to said respective said opposing side, said pair of armrests being padded;

a pair of holes positioned singly through said pair of armrests proximate to said second endpoints;

a pair of penetrations being positioned singly through said opposing sides of said seat such that each said penetration is alignable with an associated said hole when said linear section is positioned above and substantially parallel to said respective said opposing side;

a pair of pins complementary to said holes and said penetrations, each said pin being slidably coupled to a respective said armrest through said associated said hole, each said pin being reversibly insertable into an associated said penetration to reversibly couple said respective said armrest to said associated said opposing side of said seat;

a footrest coupled to said seat, said footrest extending angularly from a front of said seat, wherein said footrest is positioned on said seat such that said footrest is configured for positioning of feet of the user positioned on said seat, said footrest comprising:

a pair of fifth rods coupled to a bottom of said seat and extending angularly from said front of said seat, said fifth rods being positioned singly proximate to said opposing sides of said seat, and a plate coupled to and extending between said fifth rods distal from said seat such that said plate is substantially parallel planarly positioned below said seat;

a headrest coupled to and selectively extendable from a top end of said backrest, wherein said headrest is positioned for extension from said backrest such that said headrest is configured to support a head of the user who is positioned on said seat as said backrest is selectively angularly positioned relative to said seat, said headrest comprising:

a recess positioned in said backrest, an insert complementary to said recess, a sixth rod coupled to and extending from said insert, said sixth rod being flat, a plurality of holes positioned through said sixth rod, a channel positioned in said backrest, said channel being complementary to said sixth rod such that said sixth rod is selectively positionable within said channel, a spring pin coupled to said backrest proximate to said channel 106, wherein said holes are positioned in said sixth rod such that said holes are positioned for selectively inserting said spring pin to fixedly position said insert relative to said backrest, and a button coupled to said backrest, said button being depressible, said button being operationally coupled to said spring pin, wherein said button is positioned for depressing to decouple said spring pin from said sixth rod such that said insert is selectively positionable relative to said backrest; and wherein said rollers are positioned on said base such that said base is configured for locomotion across a surface, wherein said brake is positioned on said base such that said brake is configured for an operator to selectively couple said brake to said at least one said roller such that locomotion of said base is prevented, wherein said seat is positioned on said lift such that said lift is configured for the operator to selectively vertically position said seat relative to said base, wherein said backrest is positioned on said seat such that said backrest is configured for the operator to selectively angularly position said backrest relative to said seat.

* * * * *